US007243820B2

(12) United States Patent
Dumont

(10) Patent No.: US 7,243,820 B2
(45) Date of Patent: Jul. 17, 2007

(54) TAPPET PUMP, MAINLY FOR COSMETIC PRODUCTS

(75) Inventor: Pierre Dumont, Monchy sur Eu (FR)

(73) Assignee: Rexam Dispensing Systems S.A.S. (FR)

( * ) Notice: Subject to any disclaimer, the term of this patent is extended or adjusted under 35 U.S.C. 154(b) by 101 days.

(21) Appl. No.: 11/165,657

(22) Filed: Jun. 24, 2005

(65) Prior Publication Data

US 2006/0006196 A1 Jan. 12, 2006

Related U.S. Application Data

(63) Continuation of application No. PCT/EP2003/014320, filed on Dec. 16, 2003.

(30) Foreign Application Priority Data

Dec. 26, 2002 (FR) ..... 02 16702

(51) Int. Cl.
*B05B 11/00* (2006.01)

(52) U.S. Cl. ..... 222/321.4; 222/321.8; 222/321.9; 222/385; 222/340

(58) Field of Classification Search ..... 222/321.1, 222/321.4, 321.7–321.9, 385, 340
See application file for complete search history.

(56) References Cited

U.S. PATENT DOCUMENTS

| | | | | |
|---|---|---|---|---|
| 4,056,216 | A | 11/1977 | Kotuby | 222/385 |
| 4,371,097 | A | 2/1983 | O'Neill | 222/321 |
| 4,776,498 | A | 10/1988 | Maerte et al. | 222/321 |
| 4,958,752 | A * | 9/1990 | Maerte et al. | 222/321.4 |

OTHER PUBLICATIONS

International Search Report, Apr. 6, 2004, 2 pages.

* cited by examiner

*Primary Examiner*—J. Casimer Jacyna
(74) *Attorney, Agent, or Firm*—St. onge Steward Johnston & Reens LLC

(57) ABSTRACT

A tappet pump comprising a reduced number of components. The pump comprises a pump body, a piston, a tappet and an elastic implement which exerts its force on the tappet and on the piston by means of a unidirectional link defined by interdependent limit stops.

7 Claims, 1 Drawing Sheet

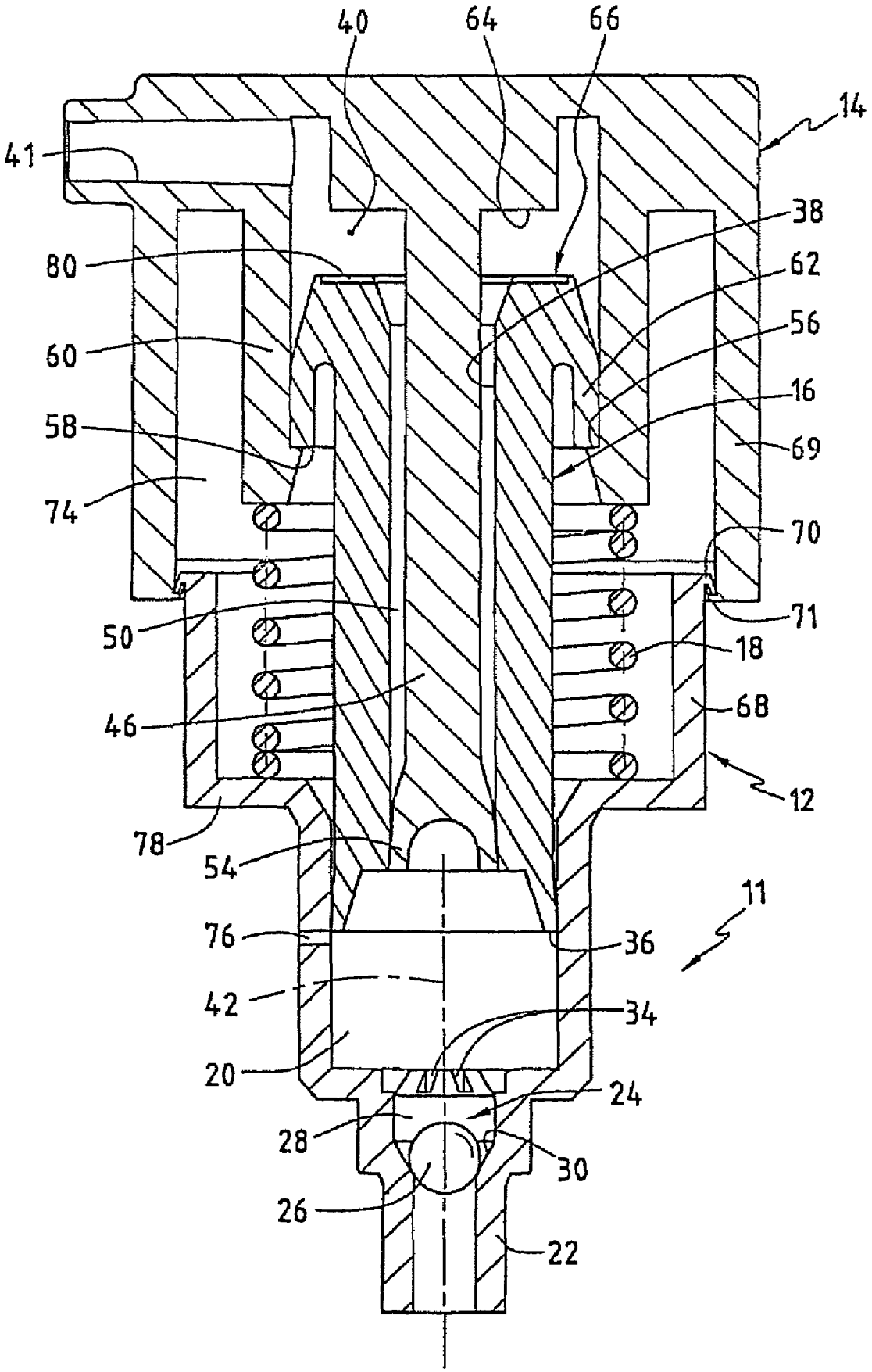
40
64
66
14
41
38
80
62
56
60
16
58
69
74
70
71
50
18
46
68
12
78
54
11
76
36
42
34
20
24
28
30
26
22

TAPPET PUMP, MAINLY FOR COSMETIC PRODUCTS

This application is a continuation of International Patent Application No. PCT/EP2003/014320 filed Dec. 16, 2003, which designates the United States and claims priority of French Patent Application No. 0216702, filed Dec. 26, 2002.

FIELD OF THE INVENTION

This invention refers to a push pump for liquid or moderately thick products, notably cosmetic products. It aims, in particular, to provide a new design of this type of pump, comprising a very low number of components and thus making it possible to reduce manufacturing costs.

French patent no. 94 12460 describes a tappet pump that comprises a dosage chamber defined within a pump body placed between two valves: one check valve that allows the product to be pumped into the chamber and one outlet valve, which opens to allow the product to be discharged when the tappet is activated. Such a device works satisfactorily, but requires a large number of parts; it is therefore expensive to manufacture and can only be justified for distributing luxury products, such as brand-name perfumes, for example. Other less-expensive products require a simpler device, notably comprising a minimum number of components. The invention makes it possible to achieve this objective.

More particularly, the invention relates to a tappet pump that comprises a pump body in which a dosage chamber is defined that communicates with a suction duct by means of a check valve, characterised in that it comprises a-piston that slides inside the said body, which makes up a moving part of the said chamber, a tappet fitted with a central rod forming a valve, where the said rod is axially mobile inside an axial channel arranged inside the said piston and leading into the said chamber; in that the said rod has an free end shaped in order to block the said channel in the proximity of the hole where it communicates with the said chamber; in that the said piston and rod are unidirectionally coupled by interdependent limit stops; in that an elastic implement exerts its force on the said tappet and piston by means of the said unidirectional link, in a direction that tends to cause the volume of the said dosage chamber to increase; and in that the said tappet comprises an operating limit stop on the end of the said piston, which is farthest from such piston when it is in its normal position, placed in such a way that the said piston can only be activated by the said tappet when the said free end of the said central rod is outside the said channel.

According to a preferred embodiment of the invention, the tappet comprises an inner skirt, whereas the piston comprises a sliding portion adapted to slide along the entire length of this skirt. This arrangement makes it possible to define the said limit stops in the inner skirt on the one hand, and on one end of the sliding portion of the piston on the other hand.

In order to prevent the piston from being activated by the said tappet, except when the said free end of the central rod is outside the channel, it is possible, for example, to make sure that the sliding friction between the said piston and body is greater than the sum of the friction between the said piston and rod, on the one hand, and between the said piston and inner skirt of the tappet, on the other hand.

Externally, the body and the tappet may include two side skirts which slide against each other and have limit stops that define a relatively stable position between the two, under the load of the said elastic implement.

BRIEF DESCRIPTION OF DRAWING

The invention will be better understood and further advantages will become more apparent in the light of the following description of a pump in accordance with its principle, provided only as an example and made in reference to the accompanying drawing, in which:

the only FIGURE is an elevational cross-sectional view of the said pump.

DETAILED DESCRIPTION OF DRAWING

The pump 11, as depicted, essentially comprises a pump body 12, a tappet 14, a piston 16 and an elastic implement 18, which in this case is made up of a coil spring mounted with initial pre-compression between the pump body and the tappet. A dosage chamber 20 is defined in the body of the pump. It communicates with a suction duct 22 by means of a check valve 24. This valve includes a ball 26 which is imprisoned and mobile inside a cavity 28 that extends from the suction duct 22 to the dosage chamber 20. The cavity 28 includes a tapered seat 30 which the ball can use as a support. Peripheral ribs 34 that extend radially are defined between the cavity and the dosage chamber; they prevent the ball from entering the said dosage chamber.

The piston 16 slides inside the body and, more particularly, inside the dosage chamber 20. It is a moving part of this chamber, and its position allows the volume of the latter to change. The end of the piston 16, on the side of the dosage chamber 20 is slightly flared in order to come frictionally into contact with the wall of the chamber 20 only in the proximity of its circular edge 36. This piston is axially crossed by a channel 38 that opens out into the dosage chamber at one of its ends and into a cavity 40 arranged between the piston and the tappet at the other end. This cavity communicates with an outlet duct 41, through which the product is distributed. The pump body 12, the piston 16, and mainly the tappet 14 (if we forget about the duct 41) admit an axis of revolution symmetry 42. In addition, the tappet 14 is fitted internally with a central rod 46 which is axially connected to the inside of the said channel 38. According to the position of the tappet in relation to the piston, the said rod 46 can therefore move axially inside the channel. Its diameter is smaller than that of the channel in order to define an annular space 50 through which the product can flow from the dosage chamber towards the cavity 40. However, the free end 54 of the rod, which is next to the dosage chamber, is widened and formed in such a way as to block the channel 38 in the proximity of its communication hole with the said chamber 42. On the other hand, the piston 16 and the tappet 14 are unidirectionally coupled by interdependent limit stops 56, 58 and the elastic implement 18 made up of the spring exerts its force on the piston by means of such unidirectional link, in a direction that tends to increase the volume of the dosage chamber. More particularly, the tappet 14 includes an inner skirt 60, while the piston 16 includes a sliding portion 62 adapted to slide along the entire length of the said skirt. In the example, the said sliding portion 62 is made up of a skirt that is external to the piston and in watertight and slightly frictional contact with the inner cylindrical surface of the said skirt 60 of the tappet. The limit stops 56, 58 are respectively defined in the inner skirt 60 and at one end of the said sliding portion 62, in other words, at the annular end of the piston skirt.

The tappet includes an internal activation limit stop 64 located at the end 66 of the piston that is farthest away from the dosage chamber. The limit stop 64 is farthest from the end 66 when the said piston is in its normal position. This normal position (depicted in the drawing) corresponds to the maximum volume of the dosage chamber 42.

The pump body 12 and the tappet 14 have two cylindrical side skirts 68, 69 one of which slides inside the other and which have limit stops 70, 71 that define a relatively stable position between them, under the load of the spring that makes up the elastic implement 18. The side skirt 68 of the pump body is an extension of the dosage chamber 42, and has a larger diameter than that of the said chamber. The side skirt 69 of the tappet makes up the outer wall of the latter. It has a larger diameter than that of the skirt 60 that works together with the piston and completely surrounds it. Consequently, an annular chamber 74 with a variable volume is defined between the outer wall of the piston 16 and the skirt 60 on the one hand, and between the two side skirts 68, 69 of the body and the tappet, on the other hand. This chamber is at normal atmospheric pressure. It surrounds the spring, which is isolated from the product. A venting hole 76 is made in the wall of the dosage chamber of the pump body in the proximity of the edge 36 of the piston when it is in the aforementioned normal position. When the pump is mounted on a bottle that contains the product, the opening of the said bottle meets a flat annular wall 78 which extends between the dosage chamber and the skirt 68, and the venting hole 76 leads into the inside of the bottle. The face of the piston which works with the activation limit stop 64 has analogous or radial ribs 80 that allow the product through, even when the said activation limit stop is in contact with the end of the piston.

The whole unit as described is arranged so that the piston can only be activated by the said tappet when the said free end 54 of the central rod 46 is outside the said channel 38, in other words, when the valve defined between the piston and the central rod is open and allows the product to be evacuated. In the example, the sliding friction between the piston 16 and the body 12 is higher than the sum of the sliding frictions between the piston 16 and the rod 46, on the one hand, and between the piston 16 and the inner skirt 60 of the tappet, on the other hand.

The invention works as follows. When the tappet 14 is activated, compressing the spring, the end 54 of the rod 46 slides along the piston and enters the dosage chamber 42, which is filled with the product. By doing so, the outlet valve of the dosage chamber opens, which allows the product to flow into the channel 38. When the limit stop 64 comes into contact with the piston, the venting hole 76 is communicated with the annular chamber 74. Consequently, the pressure inside the container is becomes the same as the atmospheric pressure. Then, with the piston 16 continuing its stroke, the product is evacuated through the tappet's output duct, since the ball 26 rests against the seat 30 and blocks the bottom of the cavity 28 preventing the product from returning to the reservoir. Once the product has been evacuated, the tappet is released and rises back up on its own thanks to the action of the spring. The outlet valve closes in this movement, since the end 54 of the rod returns to its watertight position inside the channel 38. A vacuum is created inside the dosage chamber, which makes the ball 26 rise and opens the way for the product to be sucked up into the said dosage chamber. The communication of the venting hole and the chamber is cut at the end of the piston rising stroke, when the said dosage chamber returns to its maximum volume, which restores the overall watertightness of the system.

What is claimed is:

1. A tappet pump comprising a pump body in which a dosage chamber is defined, which communicates with a suction duct by means of a check valve, characterised in that it includes a piston which slides inside the said body to form a moving part of the said chamber, a tappet fitted with a central rod forming a valve, where the said rod is axially mobile inside an axial channel arranged inside the said piston and opening out into the said chamber; in that the said rod has one free end arranged in order to block the said channel in the proximity of its communication hole with the said chamber; in that the said piston and the said tappet are coupled unidirectionally by interdependent limit stops; in that an elastic implement exerts its force on the said tappet and on the said piston by means of the said unidirectional link, in a direction that tends to increase the volume of the said dosage chamber; in that the said tappet includes an activation limit stop on one end of the said piston, which is farthest from the latter when the said piston is in its normal position, arranged in such a way that the said piston can only be activated by the said tappet when the said free end of the said central rod is outside the said channel; in that the said elastic implement is a coil spring installed between and in contact with the said pump body and the said tappet; and in that said coil spring is disposed outside said dosage chamber.

2. A pump according to claim 1, characterised in that the said tappet includes an inner skirt and in that the said piston includes a sliding portion adapted in order to slide along the entire length of the said skirt.

3. A pump according to claim 2, characterised in that the said limit stops are respectively defined in the said inner skirt and on one end of the said sliding portion.

4. A pump according to claim 2, characterised in that the sliding friction between the said pump and the said body is greater than the sum of the sliding frictions between the said piston and the said rod and between the said piston and the said inner skirt of the tappet.

5. A pump according to claim 1, characterised in that the said channel leads into a cavity that communicates with a outlet duct.

6. A pump according to claim 1, characterised in that the said body and the said tappet have side skirts which slide against each other and have limit stops that define a relatively stable position between the two, under the load of said elastic implement.

7. A pump according to claim 1, characterised in that a venting hole is made in the wall of the said dosage chamber of the said pump body in the proximity of the edge of the piston, when the latter is in the aforementioned normal position.

* * * * *